United States Patent [19]

Nagashima et al.

[11] 3,977,361

[45] Aug. 31, 1976

[54] MAGNETIC BRUSH DEVELOPING DEVICE

[75] Inventors: Toshio Nagashima, Sagamihara; Mitsuharu Nakaguchi, Chigasoki; Takuzo Tsukamoto, Yamato; Ryuzo Okada, Azugi; Hidetoshi Kito, Kawasaki; Kenichi Handa, Sagamihara, all of Japan

[73] Assignee: Fuji Xerox Co., Ltd., Tokyo, Japan

[22] Filed: May 13, 1975

[21] Appl. No.: 576,998

[52] U.S. Cl. ..... 118/637; 427/18

[51] Int. Cl.[2] ..... G03G 15/09

[58] Field of Search ..... 118/637; 427/18; 355/3 DD

[56] References Cited

UNITED STATES PATENTS

| | | | |
|---|---|---|---|
| 3,392,432 | 7/1968 | Naumann | 355/3 DD |
| 3,457,900 | 7/1969 | Drexler | 118/637 |
| 3,543,720 | 12/1970 | Drexler et al. | 118/637 |
| 3,641,980 | 2/1972 | Bickmore | 118/637 |
| 3,654,902 | 4/1972 | Hakanson | 118/637 |
| 3,724,422 | 4/1973 | Latone et al. | 118/637 |
| 3,881,446 | 5/1975 | Kurita et al. | 118/637 |
| 3,908,595 | 9/1975 | Okada | 118/637 |

OTHER PUBLICATIONS

IBM Technical Disclosure Bulletin; vol. 14, No. 9, Feb. 1972, pp. 2787–2788; Magnet Configuration for Magnetic Brush Developer; Hoekzema, R. J.

IBM Technical Disclosure Bulletin; vol. 2, No. 2, Aug. 1959, Development of Electrostatic Images; Medley, H. C.

*Primary Examiner*—Mervin Stein
*Assistant Examiner*—Douglas Salser
*Attorney, Agent, or Firm*—Gerald J. Ferguson, Jr.; Joseph J. Baker

[57] ABSTRACT

A magnetic brush developing device including a plurality of developing rollers each consisting of a cylindrical stationary magnet and a cylindrical sleeve rotating around said magnet, said plurality of developing rollers being disposed among the surface of a latent image forming member, wherein said cylindrical stationary magnets each have (a) a developing magnetic pole positioned in a portion facing the surface of latent image forming member, (b) a transporting magnetic pole positioned rearwardly of said developing magnetic pole in the travelling direction of a developing agent and having an opposite polarity to that of the developing magnetic pole, and (c) an auxility transporting magnetic pole positioned in a portion facing the preceding developing roller in the travelling direction of developing agent and having a polarity identical with the polarity of said transporting magnetic pole, said developing magnetic poles having the identical polarity and thus delivery and receipt of the developing agent between the adjacent developing rollers is effected between the transporting magnetic pole of the preceding developing roller and the developing magnetic pole of the succeeding developing roller.

1 Claim, 2 Drawing Figures

MAGNETIC BRUSH DEVELOPING DEVICE

BACKGROUND OF THE INVENTION

1. Field of the Invention:

This invention relates to a magnetic brush developing device for developing an electrostatic latent image formed by an electrophographic process, and more particularly to a magnetic brush developing device, wherein magnets are used for producing a brush-like bur of a developing agent consisting of iron powder carrier and toner, the aforesaid brush-like bur of developing agent sliding along the surface of latent image.

2. Description of the Prior Art:

The magnetic brush developing device has been well known as a developing device for use in a dry type electrophotographic reproducing apparatus and is particularly useful for reproduction of a solid black portion or half-tone portion, rather than the cascade development is.

If the magnetic brush developing device equipped with a single magnetic roller is employed for a high speed reproducing apparatus, it follows that a developing time is compressed; and the feeding of an adequate amount of toner to the latent image is failed, resulting in the unsatisfactory developing in the solid black portion.

Increase in reproduction speed of a reproducing apparatus is the needs of the times. For meeting the requirements, various attempts have hitherto been made, as a result of which there has been proposed a device, in which a plurality of magnetic rollers are employed for compensating for reduction in developing timer per roller. In the device, a plurality of developing rollers are provided in vertically parallel relation to one another along the latent image formed surface of a sensitive member. The device, however, suffers from the drawbacks that when a developing agent fed to the preceding developing roller is fed successively to the succeeding rollers, uniform delivery of the developing agent between the adjacent rollers is failed, resulting in the concentration of the developing agent to only a single roller, the local accumulation of the developing agent or leakage to the outside of the developing device.

SUMMARY OF THE INVENTION

It is accordingly an object of the present invention to provide a magnetic brush developing device, wherein delivery of a developing agent between the adjacent magnetic rollers, i.e. transportation of a developing agent, is improved, thereby permitting a satisfactory reproduction of solid black portion, even for a high speed reproduction.

Respective magnetic roller used in the present invention is of a cylindrical magnet, which is surrounded by a rotatable non-magnetic sleeve. In the stationary magnet, rotary sleeve type magnetic roller, the magnet may serve to transport a developing agent as well as to develop a latent image, unlike the rotary magnet type magnetic roller, and the cylindrical magnet is more efficient for produce a bur of developing agent, as compared with an angular magnet. In other words, the former permits formation of a bur of developing agent in opposite ends in the axial direction of roller.

The present invention also relates to magnetization pattern on a cylindrical magnet of each of the aforesaid stationary magnet, rotary sleeve type cylindrical magnets, and is directed to providing developing rollers which is improved in transportation of a developing agent.

DETAILED DESCRIPTION OF THE PREFERRED EMBODIMENT

Description will hereunder be given to an embodiment of the present invention in conjunction with the accompanying drawings.

Figure 1:
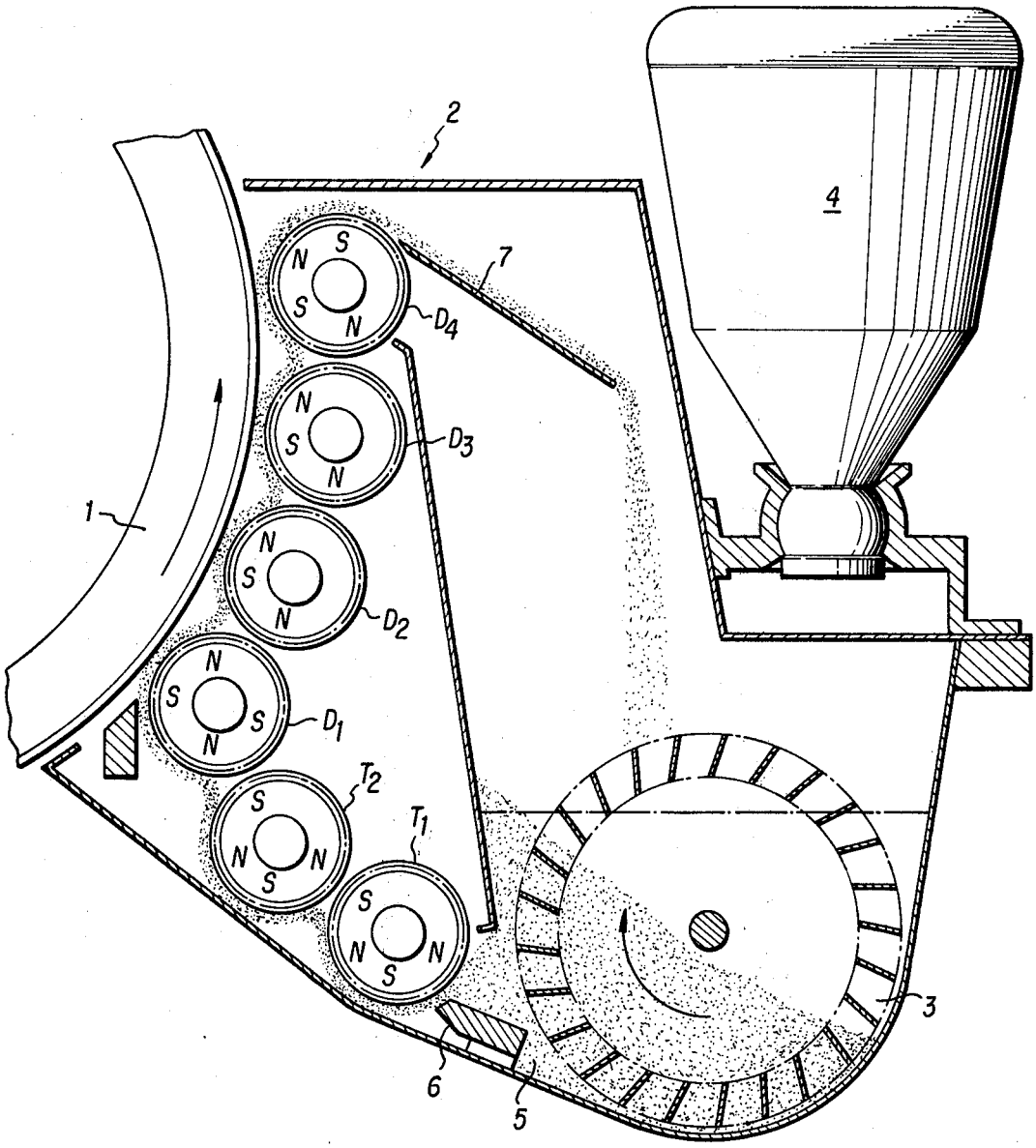
FIG. 1 is illustration showing the outline of the developing device to which the present invention is applied.

FIG. 1 illustrates the status in which an electrostatic latent image formed on a latent image forming member 1 according to the electric charging and exposure steps is being developed in a developing device 2. A paddle wheel 3 serves to feed to a transporting magnetic roller $T_1$ a developing agent 5 consisting of iron powder carrier and toner which is fed by a proper amount from a toner bottle 4. The developing agent, whose amount is controlled by a trimmer blade 6, is delivered to a transporting magnetic roller $T_2$, and then transported to developing rollers $D_1$, $D_2$, $D_3$ and $D_4$ successively. Then, the developing agent is scraped off from the developing roller $D_4$ by a pick-off baffle 7 to be recovered to the developing agent reservoir. While the developing agent is transported from the developing roller $D_1$ to the developing roller $D_4$, toner contained in the developing agent is alone attracted to the latent image. Accordingly, toner is supplied to the reservoir 3 from the toner bottle 4 by an amount commensurate with the consumed toner.

Figure 2:
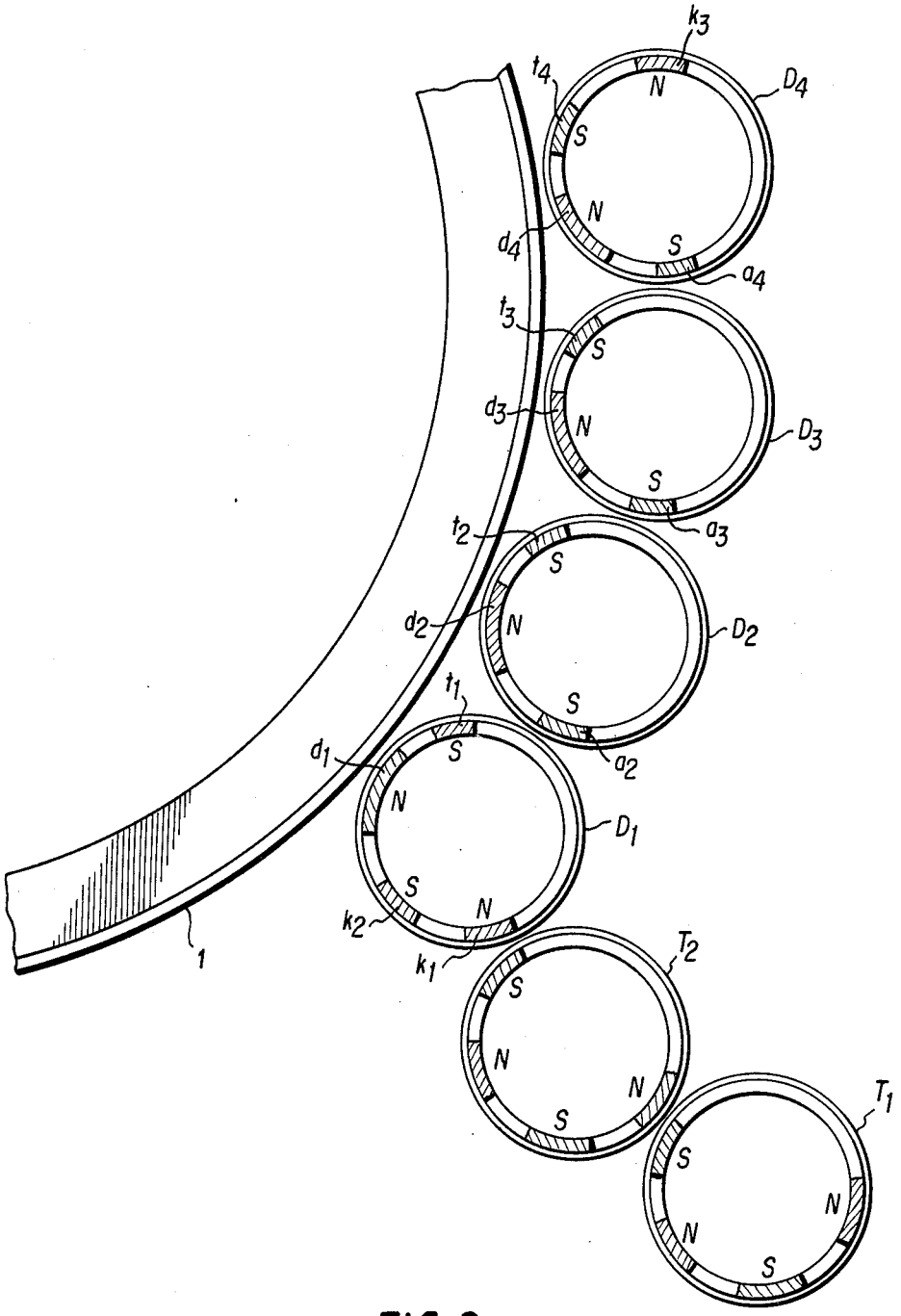
FIG. 2 is a diagramatical view showing the arrangement of the magnetic poles of respective magnetic rollers according to an embodiment of the present invention.

The developing agent travels along the developing rollers in the form of layer as shown in FIG. 1, without clinging to the surfaces of developing rollers. This is owing to magnetization pattern on the magnets of each developing roller, as shown in FIG. 2.

The developing rollers $D_1$, $D_2$, $D_3$ and $D_4$ respectively have a developing magnetic pole $d_1$, $d_2$, $d_3$ or $d_4$ for serving to develop a latent image as well as to transport the developing agent, a transporting magnetic pole $t_1$, $t_2$, $t_3$or $t_4$for mainly contributing to transporting the developing agent between the adjacent developing rollers, said transporting magnetic poles having an opposite polarity to the polarity of the developing magnetic poles, and an auxiliary transporting magnetic pole $a_2$, $a_3$ or $a_4$which facilitates transportation of the developing agent between the adjacent developing rollers. In addition to those magnetic poles, for facilitating shift of the developing agent within the same roller or assisting the developing roller to receive the developing agent from the transporting roller, there may be provided further magnetic poles $k_1$ and $k_2$ in the developing roller $D_1$ or the magnetic pole $k_3$ in the developing roller $D_4$.

The developing agent transported by the transporting rollers $T_1$ and $T_2$ to the developing roller $D_1$ is shifted to the developing magnetic pole $d_1$ by the action of the magnetic poles $k_1$ and $k_2$. The developing magnetic pole $d_1$ is disposed on the roller substantially in facing relation to the surface of latent image forming member 1 and provides a sufficiently wide range of developing area, in cooperation with the transporting magnetic pole $t_1$, thereby permitting the magnetic brush to slide over the whole surface of latent image. With rotation of the sleeves, the developing agent is shifted from the developing magnetic pole $d_1$ of the developing roller $D_1$ to the transporting magnetic pole $t_1$ thereof and then delivered to the developing magnetic pole $d_2$ of the succeeding developing roller $D_2$. The auxiliary transporting magnetic pole $d_2$ has the identical polarity with that of the transporting magnetic pole $t_1$ of the preceding developing roller $D_1$, such that the developing agent may be prevented from passing to the rear part of the developing roller with respect to the surface of image forming member. Furthermore, the auxiliary transporting magnetic pole $d_2$ of the developing roller $D_2$ is positioned in a portion substantially facing the preceding developing roller $D_1$, whereby a sufficient amount of developing agent is delivered from the transporting magnetic pole $t_1$ of the preceding developing roller to the developing magnetic pole $d_2$ of the succeeding developing roller $D_2$. Thus, the developing agent is smoothly transported to the developing rollers, without undergoing a physical force.

The developing agent is transported to the rear mostly positioned or top developing roller $D_4$ in like manner, and then scraped off therefrom by the pick-off baffle 7 to be returned to the developing agent reservoir.

As is apparent from the foregoing, the polarity of each developing magnetic pole of developing roller is idential, such that the developing agent may be transported via $d_1$ (N) → $t_1$ (S) → $d_2$ (N) → $t_2$ (S) → $d_3$ (N) → $t_3$ (S) → $d_4$ (N) → $t_4$ (S).

Reference has had to the embodiment in which four developing rollers are employed for transporting the developing agent from below towards above of the developing device. The number of developing roller is variable according to the speed of reproduction, and the position of the magnetic poles may be altered. In addition, in case the developing agent is transported from above towards below, the position of magnetic poles is necessarily changed. Those change and modifications are included within the scope of the invention.

Since developing device of the present invention provides a sufficiently long span of developing area and is improved in transportation of a developing agent, there is obtained a copy of high quality and life of the developing agent is extended.

While the invention has been described in detail and with reference to specific embodiments thereof, it will be apparent to one skilled in the art that various changes and modifications can be made therein without departing from the spirit and scope thereof.

What is claimed is:

1. A magnetic brush developing device including a plurality of developing rollers each consisting of a cylindrical stationary magnet and a cylindrical sleeve rotating around said magnet, said plurality of developing rollers being disposed along the surface of a latent image forming member, wherein;

said cylindrical stationary magnets each have (a) a developing magnetic pole positioned in a portion facing the surface of latent image forming member, (b) a transporting magnetic pole positioned rearwardly of said developing magnetic pole in the travelling direction of a developing agent and having an opposite polarity to that of the developing magnetic pole, and (c) an auxiliary transporting magnetic pole positioned in a portion facing the preceding developing roller in the travelling direction of developing agent and having a polarity identical with the polarity of said transporting magnetic pole, said developing magnetic poles having the identical polarity and thus delivery and receipt of the developing agent between the adjacent developing rollers is effected between the transporting magnetic pole of the preceding developing roller and the developing magnetic pole of the succeeding developing roller.

* * * * *